United States Patent [19]

Yanagisawa et al.

[11] Patent Number: 5,063,451

[45] Date of Patent: Nov. 5, 1991

[54] HAND HELD RECORDING APPARATUS WITH WINDOW ON LOWER BODY PORTION FOR VIEWING RECORDING POSITION

[75] Inventors: Ryozo Yanagisawa, Matsudo; Hiroshi Tanioka; Kiyoshi Kaneko, both of Yokohama; Toshiaki Harada; Kikuo Yoshikawa, both of Kawasaki; Noboru Koumura, Narashino; Toshiharu Inui, Yokohama, all of Japan

[73] Assignee: Canon Kabushiki Kaisha, Tokyo, Japan

[21] Appl. No.: 375,981

[22] Filed: Jul. 6, 1989

[30] Foreign Application Priority Data

Jul. 11, 1988 [JP] Japan ..... 63-170847
Jul. 18, 1988 [JP] Japan ..... 63-177047

[51] Int. Cl.[5] ..... B41J 3/39; B41J 2/32; B41J 2/05

[52] U.S. Cl. ..... 346/143; 346/140 R; 346/76 PH; 400/193; 400/88; 400/120; 400/126

[58] Field of Search ..... 358/296, 473, 474, 482, 358/483, 486, 488, 494, 497; 382/59; 346/76 PH, 143; 400/193, 88

[56] References Cited

U.S. PATENT DOCUMENTS 4,436,439 3/1984 Koto ..... 346/143
4,819,083 4/1989 Kawai ..... 358/473

*Primary Examiner*—Benjamin R. Fuller
*Assistant Examiner*—Scott A. Rogers
*Attorney, Agent, or Firm*—Fitzpatrick, Cella, Harper & Scinto

[57] ABSTRACT

A recording apparatus for effecting recording on a recording medium is portable and capable of bearing against the recording medium. The recording apparatus comprises recording means for effecting recording on the recording medium, and control means for controlling the ON and OFF of recording by the recording means.

24 Claims, 9 Drawing Sheets

HAND HELD RECORDING APPARATUS WITH WINDOW ON LOWER BODY PORTION FOR VIEWING RECORDING POSITION

BACKGROUND OF THE INVENTION

1. Field of the Invention

This invention relates to a recording apparatus which is capable of recording images such as characters, figures or video images on a recording medium such as plain paper, worked paper or a plastic sheet for OHP.

2. Related Background Art

Various types of recording apparatuses for recording images such as characters and figures have heretofore been developed. They include, for example, a so-called serial printer in which a recording head effects recording while moving relative to a recording sheet, a so-called line printer in which recording is effected on a recording sheet being conveyed by a line-shaped recording head, and a so-called handy printer in which the apparatus body having a recording head is manually scanned relative to a recording sheet to thereby effect recording.

The recording positioning when these recording apparatuses effect recording is accomplished, for example, in the serial printer or the line printer, by causing the end portion of a recording sheet to bear against a guide member provided with a predetermined position as a reference and setting the recording sheet, or by inputting an image signal so as to correspond to a recording position. Also, in the handy printer as shown in FIG. 11 of the accompanying drawings, recording positioning marks a, b and c are usually provided on the apparatus body and the design is such that when the apparatus body is scanned in the direction of arrow I, recording is effected between the marks a and b and recording is started from the mark c.

However, the aforedescribed recording apparatuses have suffered from the following problems.

In the serial printer and the line printer, recording is limited to a sheet-like recording media and cannot be effected on a notebook or a book and further, recording positioning is cumbersome.

On the other hand, the handy printer can effect recording on a notebook or the like, but because of the manual scanning, the image may sometimes deviate in the direction of scanning and there is the possibility that it is difficult to record the same image accurately. Also, as regards the recording positioning, the actual recording position cannot be looked at squarely, and this leads to the problem that skill is required for accomplishing highly accurate positioning.

That is, the prior-art handy printer can accomplish recording with the amount of movement thereof relative to the recording sheet by manual scanning detected because the recording information is characters and accordingly the recording density is 8 pels or less, but in the case of an image (256×256 picture elements) in which the recording information is of the order of 16 pels, the recording density becomes higher and the recording width also becomes wider and therefore, there has been the problem that irregularity of recording scan is liable to occur and the image may be deteriorated.

SUMMARY OF THE INVENTION

It is an object of the present invention to provide a recording apparatus which can obtain images of high quality.

It is another object of the present invention to provide a recording apparatus which can obtain clear-cut images.

It is still another object of the present invention to solve the above-noted problems peculiar to the prior-art apparatuses and to provide a recording apparatus which can record the same images highly accurately on a notebook or the like and can also reliably accomplish recording positioning.

It is yet still another object of the present invention to solve the above-noted problems peculiar to the prior-art apparatuses and to provide a recording apparatus which can record even an image of the order of 16 pels at a desired position on a recording medium without causing the deterioration of the image.

DESCRIPTION OF THE PREFERRED EMBODIMENTS

Description will hereinafter be made of a recording apparatus to which an embodiment of the present invention is applied.

In the embodiments hereinafter described, recording positioning can be accomplished easily and reliably by setting the apparatus on a recording medium while visually comfirming a positioning portion indicative of a recording area.

Also, recording means can be automatically scanned by scanning means to thereby effect predetermined recording and therefore, even for the same image, an image of high accuracy which is free of image deviation can be obtained stably and further, recording becomes possible also on various recording mediums such as notebooks and the like.

FIRST EMBODIMENT

Figure 1:
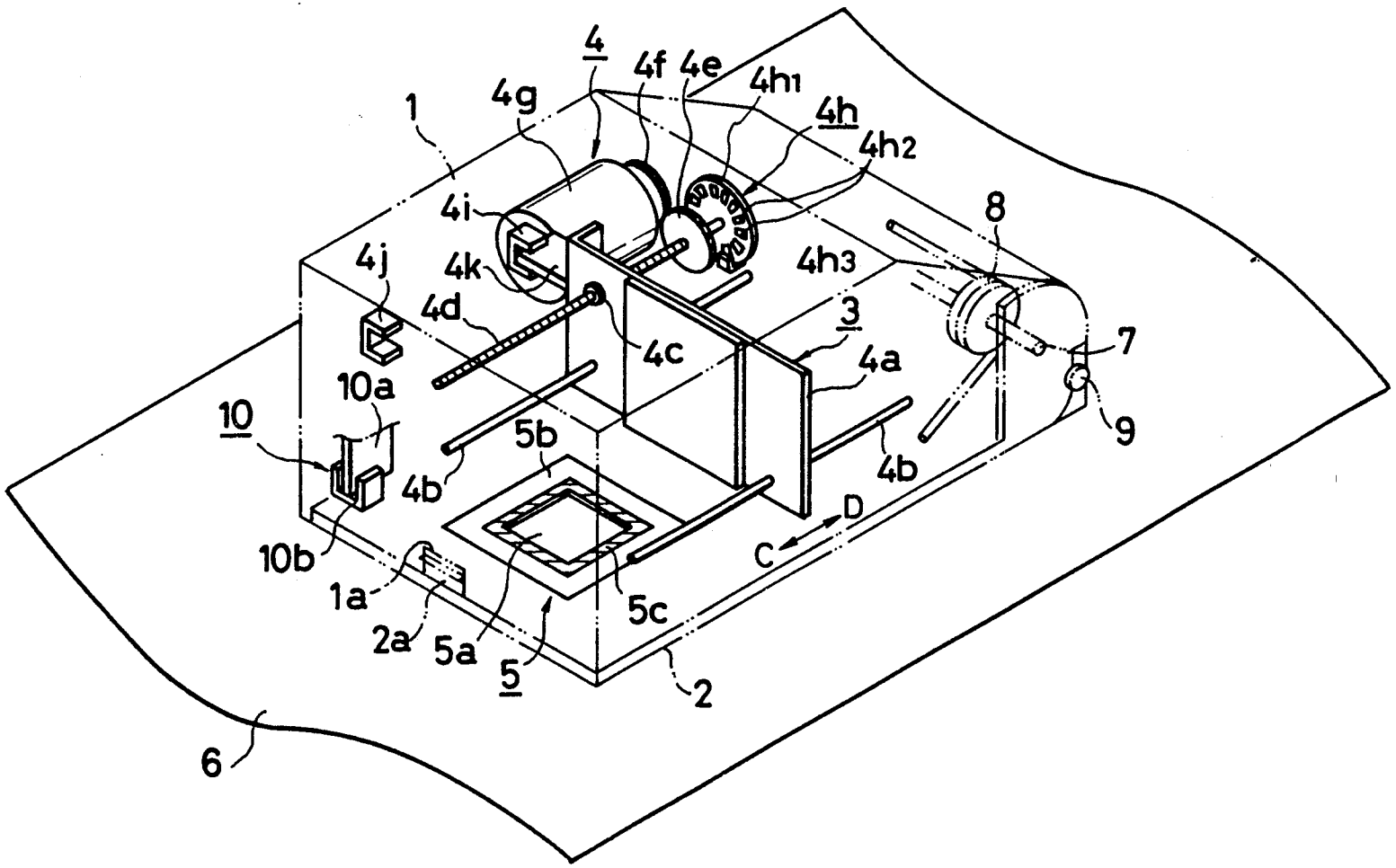
FIG. 1 is a schematic perspective view showing a recording apparatus according to a first embodiment of the present invention.
Figure 2:
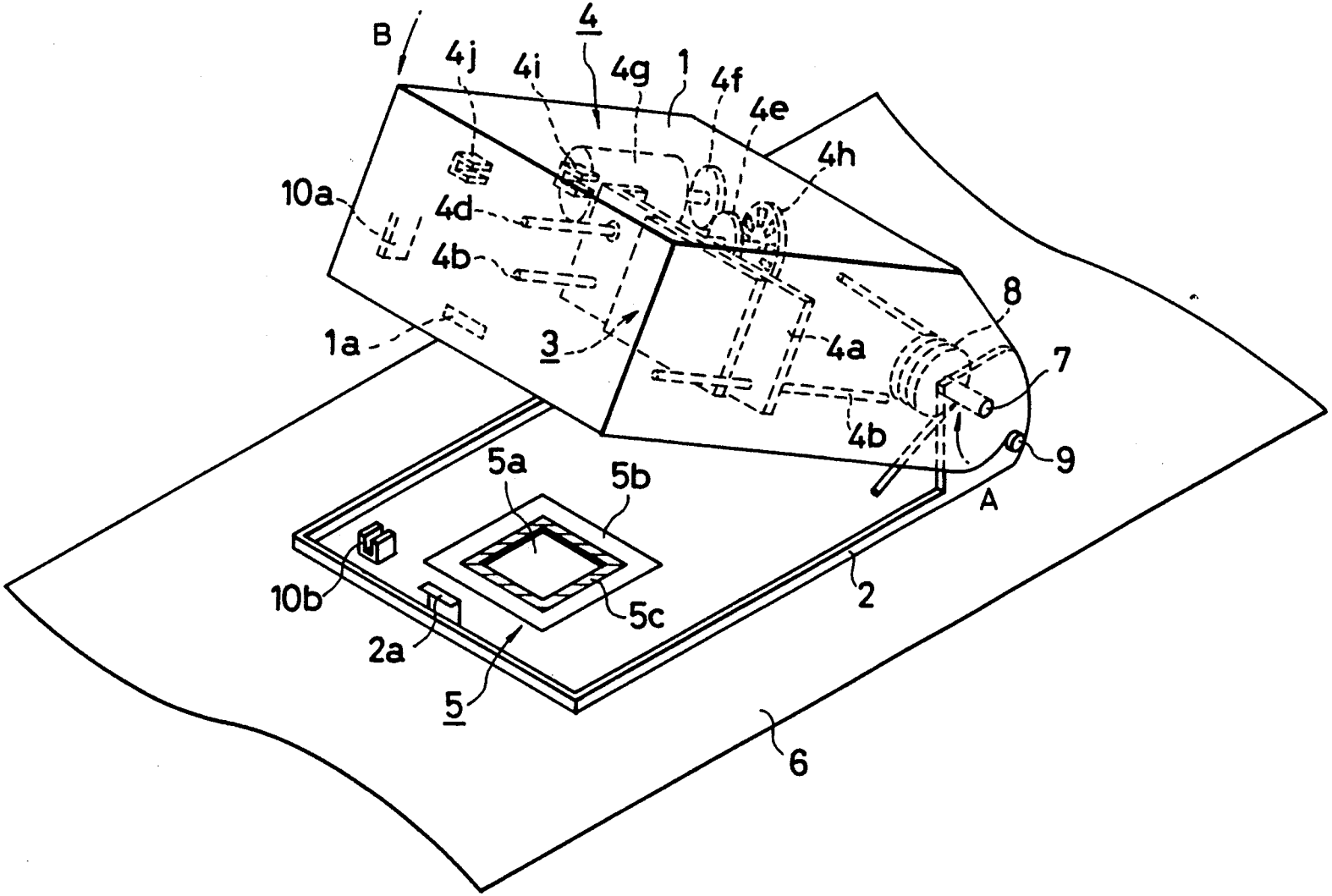
FIG. 2 illustrates a state in which an upper jaw portion is opened.

FIG. 1 is a schematic perspective view of the entire recording apparatus, and FIG. 2 illustrates a state in which the apparatus is opened.

The epitome of the whole will first be described. The apparatus body is constructed so that an upper jaw portion 1 and a lower jaw portion 2 are openable, and a recording head 3 providing recording means and scanning means 4 for the head 3 are provided in the upper jaw portion 1, and a positioning portion 5 is provided in the lower jaw portion 2.

The positioning portion 5 is designed such that it can be visually confirmed when the upper jaw portion 1 is opened. Accordingly, by opening the upper jaw portion 1 and visually confirming the positioning portion 5 when the apparatus body is placed on a recording medium 6, the recording position can be confirmed. Design is also made such that when the upper jaw portion 1 is closed after positioning, an image is automatically recorded on the positioning portion of the recording medium 6.

The constructions of the above-described various portions will be described in greater detail in succession.

The upper jaw portion 1 is formed into a box-like shape, and the lower jaw portion 2 is formed into a plate-like shape. The upper jaw portion 1 and the lower jaw portion 2 are pivotally connected together at an end portion thereof by a shaft 7, and the two portions are constructed so as to be openable and closable like the mouth of an alligator.

A spring 8 is mounted on the shaft 7 and biases the upper jaw portion 1 and the lower jaw portion 2 in a direction to open them (the direction of arrow A in FIG. 2). Further, a stop 9 is formed on the upper jaw portion 1 and the lower jaw portion 2 so that when the upper jaw portion 1 is opened, it is pivotally moved in the direction of arrow A by the action of the spring 8 and that by the stop 9, the upper jaw portion 1 maintains its open state at a predetermined angle with respect to the lower jaw portion 2.

The upper jaw portion 1 can be closed by being pushed in the direction of arrow B in FIG. 2 against the biasing force of the spring 8, and there is provided a sensor 10 for detecting the closed state at this time. The closed state of the upper jaw portion 1 and the lower jaw portion 2 is maintained by a resilient restraining portion 2*a* which is provided on the lower jaw portion 2 being engaged with the recess 1*a* of the upper jaw portion 1. The sensor 10 is comprised of a light-intercepting plate 10*a* projectedly provided on the open end portion of the upper jaw portion 1, and a photointerrupter 10*b* provided on the open end portion of the lower jaw portion 2, and design is made such that when the upper jaw portion 1 is closed, the light-intercepting plate 10*a* intercepts the light of the photointerrupter 10*b*, whereby the opened or closed state of the upper jaw portion 1 and the lower jaw portion 2 may be detected.

Figure 3:
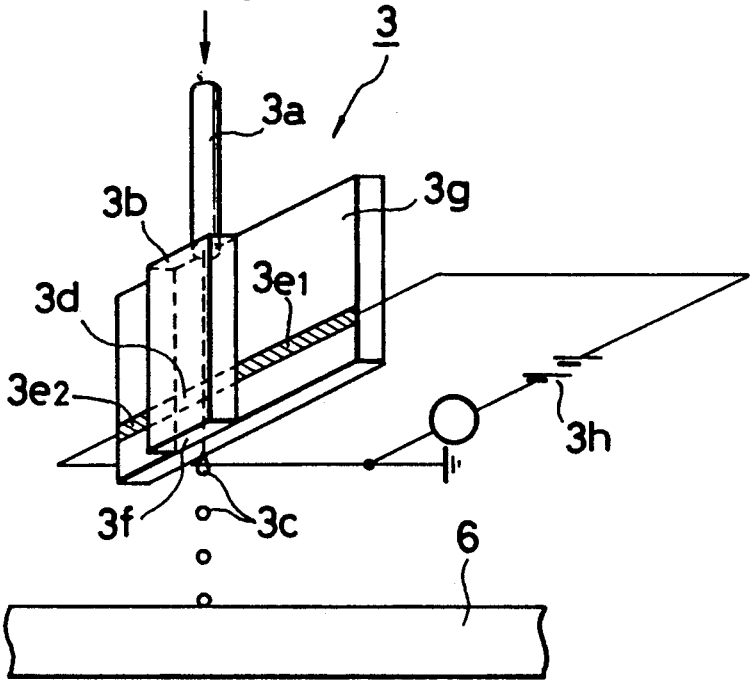
FIG. 3 is an illustration of a recording head.

Description will now be made of the recording head 3 which is the recording means. In the present embodiment, the recording head 3 is a so-called ink jet type recording head as shown in FIG. 3, and this head 3 has a recording density of 16 dots/mm in the main scanning direction and is multi-nozzled for 256 dots. The principle of this head is as follows. Ink 3*c* is introduced from an ink inlet tube 3*a* into an ink liquid chamber 3*b*. There the expansion of the liquid or the production of a bubble is caused by the pulse-like heat generation of a heat generating member 3*d* provided in the liquid chamber 3*b* upon the supply of electric power through electrodes $3e_1$ and $3e_2$. With this change in state, the ink 3*c* is discharged and flies as a small droplet from an orifice 3*f* and adheres to the recording medium 6, whereby recording is accomplished. The heat generating member 3*d* is provided on a base plate 3*g*, and the voltage of a power source 3*h* is applied thereto in accordance with an input signal which will be described later, whereby the heat generating member 3*d* is heated in conformity with the input signal and the ink 3*c* flies to the recording medium 6 in conformity with said heating.

The scanning means 4 for scanning the recording head 3 is constructed as shown in FIG. 1.

The recording head 3 is mounted on a head mounting plate 4*a*, and two guide shafts 4*b* mounted on the upper jaw portion 1 are inserted into the vicinity of the opposite end portions of the head mounting plate 4*a*. Accordingly, the head mounting plate 4*a* is slidable in the directions of arrows C and D along the guide shafts 4*b*. A female screw 4*c* is provided at a predetermined location on the head mounting plate 4*a*, and a male screw 4*d* is threadably engaged with the female screw 4*c*. This male screw 4*d* is rotatably but immovably mounted on the upper jaw portion 1, and a gear 4*e* is secured to the vicinity of the end of the male screw, and is connected to a scan motor 4*g* through a motor gear 4*f*. Thus, as the scan motor 4*g* revolves in the forward direction or the reverse direction, the male screw 4*d* is rotated and by the rotation thereof, the head mounting plate 4*a* slides in the direction of arrow C or the direction of arrow D, whereby the recording head 3 scans in the sub-scanning direction.

There is also provided an encoder 4*h* for detecting the amount of rotation of the male screw 4*d*. This encoder 4*h* has a disc-like encode plate $4h_1$ mounted on the end portion of the male screw 4*d* and adapted to rotate with the rotation of the male screw 4*d*. Slits $4h_2$ are provided at equal intervals in the outer periphery of the encode plate $4h_1$, and a photointerrupter $4h_3$ is provided in opposed relationship with one of these slits $4h_2$. Accordingly, as the encode plate $4h_1$ is rotated by the rotation of the male screw 4*d*, the slits $4h_2$ switch the photointerrupter $4h_3$, and the amount of sub-scanning of the recording head 3 is detected by the output pulse of the photointerrupter $4h_3$ and said amount of sub-scanning is controlled by a control system which will be described later.

Further, photointerrupters 4*i* and 4*j* are mounted at predetermined positions on the upper jaw portion 1, i.e., the home position of the recording head 3 and the reverse position after the head 3 has been moved in the direction of arrow C. When the recording head 3 is scanned to said position, a light-intercepting plate 4*k* formed integrally with the head mounting plate 4*a* intercepts the lights of the photointerrupters 4*i* and 4*j* and the scanning range of the recording head 3 is controlled by the signals from the photointerrupters 4*i* and 4*j*.

The positioning portion 5 will now be described.

A square recording window 5*a* is formed at a predetermined location on the lower jaw portion 2. This recording window 5*a* is of a size somewhat larger than the size of the image recorded by the recording head 3, and a square-shaped transparent window 5*b* formed of a transparent substance such as transparent resin or transparent glass is formed around the recording window 5*a*. A positioning mark 5*c* such as a tape or a colored substance such as a paint is formed on the peripheral edge of the transparent window 5*b*. The portion surrounded by this positioning mark 5*c* is the recording area to be recorded on the recording medium by the recording head 3, and can be visually confirmed when the upper jaw portion 1 is opened as shown in FIG. 2.

The recording operation of the recording apparatus constructed as described above will now be described.

First, the operator carries the apparatus body and places it on the recording medium 6. At this time, the upper jaw portion 1 is in a state in which its mouth is opened by the spring 8. Accordingly, the recording window 5*a* can be visually confirmed, and the positioning mark 5*c* of the recording window 5*a* is registered with a location on the recording medium at which recording is to be effected.

When the upper jaw portion 1 is pushed in the direction of arrow B in FIG. 2 to close the upper jaw portion 1 and the lower jaw portion 2 after said positioning has been done, the light-intercepting plate a switches the photointerrupter 10*b*, and the recording switch is closed by the signal thereof.

By the closing of the recording switch, the scan motor 4*g* is driven and the recording head 3 is scanned in the direction of arrow C in FIG. 1. At this time, the slits $4h_2$ of the encode plate $4h_1$ are counted by the photointerrupter $4h_3$, and after a predetermined number has been counted, that is, after the recording head 3 has come into the positioning mark 5*c*, the recording head 3 effects recording on each line in confirmity with an image signal.

This image signal is supplied from an information producing apparatus, not shown, such as a document reader, a personal computer or a word processor, or an outside information source such as a facsimile apparatus, a television set or a video apparatus.

The recording of one line is effected in synchronism with the count number of the encoder 4*h*, and this recording is effected in the sub-scanning direction by a predetermined distance, in the case of the present embodiment, 16 mm, whereupon the recording of one line is completed. Accordingly, the image obtained by this recording is an image of a size 16 mm ×16 mm (256×256 dots).

It is a matter of course that upon completion of said recording, the recording head 3 is positioned within the positioning mark 5*c* of the recording window 5*a*.

When said recording is completed, the recording head 3 is further scanned in the direction of arrow C in FIG. 1, and when the light-intercepting plate 4*k* revolves in the reverse direction and the recording head 3 is scanned in the direction of arrow D in FIG. 1. When the light-intercepting plate 4*k* switches the photointerrupter 4*i*, the scan motor 4*g* is stopped and the recording head 3 is stopped at the home position.

It is not necessary that the upper jaw portion 1 be manually held down when the recording head 3 is being scanned in the direction of arrow D in FIG. 1 or when the scanning of the recording head 3 is terminated or stopped.

A control system for controlling the driving as described previously will now be described with reference to the block diagram of FIG. 4.

Figure 4:
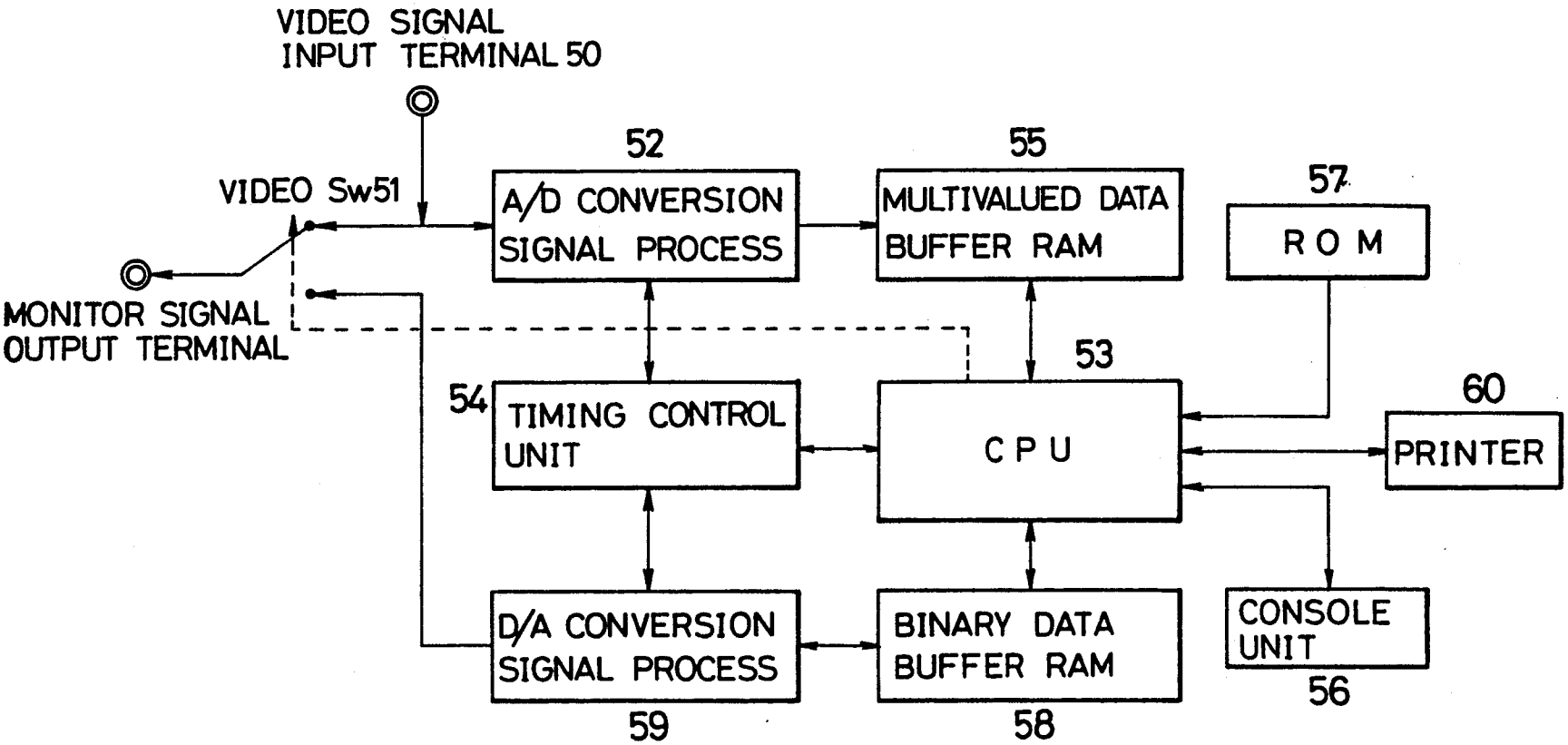
FIG. 4 is a block diagram of a control system.

In FIG. 4, a video signal reproduced from a video recorder or an integral type video camera or the like or an ordinary television signal is input as NTSC signal to a video input terminal 50, and upon change-over of a video switch 51, it can be monitored by an outside monitor (for example, a TV receiver). On the other hand, the NTSC signal is input to a signal processing circuit 52 for receiving the NTSC composite signal as an input, extracting a synchronizing signal and an image luminance signal and analog/digital-converting the same. This circuit 52 is operated by the control of a timing control unit 54 controlled and actuated by a CPU 53, and the output thereof is memorized as an 8-bit density signal in a multivalued data buffer RAM 55 (in the present embodiment, memorization of 265×256 picture elements of the substantially central portion of one frame screen is effected).

On the other hand, said memorizing operation is stopped by the depression of the image freeze switch of a console unit 56, and the CPU 53 executes a binarizing process to record said memorized image data in accordance with the program of an ROM 57 storing therein a microprogram which will be described later, and stores said binarized image data again into a binary data buffer RAM 58. This binary signal is again converted into the NTSC composite signal by a digital/analog conversion signal processing circuit 59, and upon change-over of the video switch 51, the operator can confirm the recorded image by a monitor. The operation of the image freeze switch is performed by the operator at a desired time.

Here, the aforedescribed recording apparatus is connected as a printer unit 60 to the CPU 53, and when the CPU 53 discriminates the light interception of the photointerrupter 10*b* by the depression of the upper jaw portion 1, recording is started. As regards the binarizing process, for example, the simple binarization by a predetermined threshold value prepared in ROM 57, the binarizing process extracting the outline portion, or the pseudo-intermediate tone process typified by the dither method or the error diffusion method can be selected by the instructions of the console unit 56.

The control procedure of the whole will now be described with reference to the flow chart of FIG. 5.

At step S1, the depression of the video changeover switch of the console unit 56 is detected, and with the depression of this switch, the program branches off to step S2, and the video switch 51 for outputting one of the outside video signal and the binary video signal binarized in the recording apparatus to the outside monitor is switching-controlled.

Figure 5:
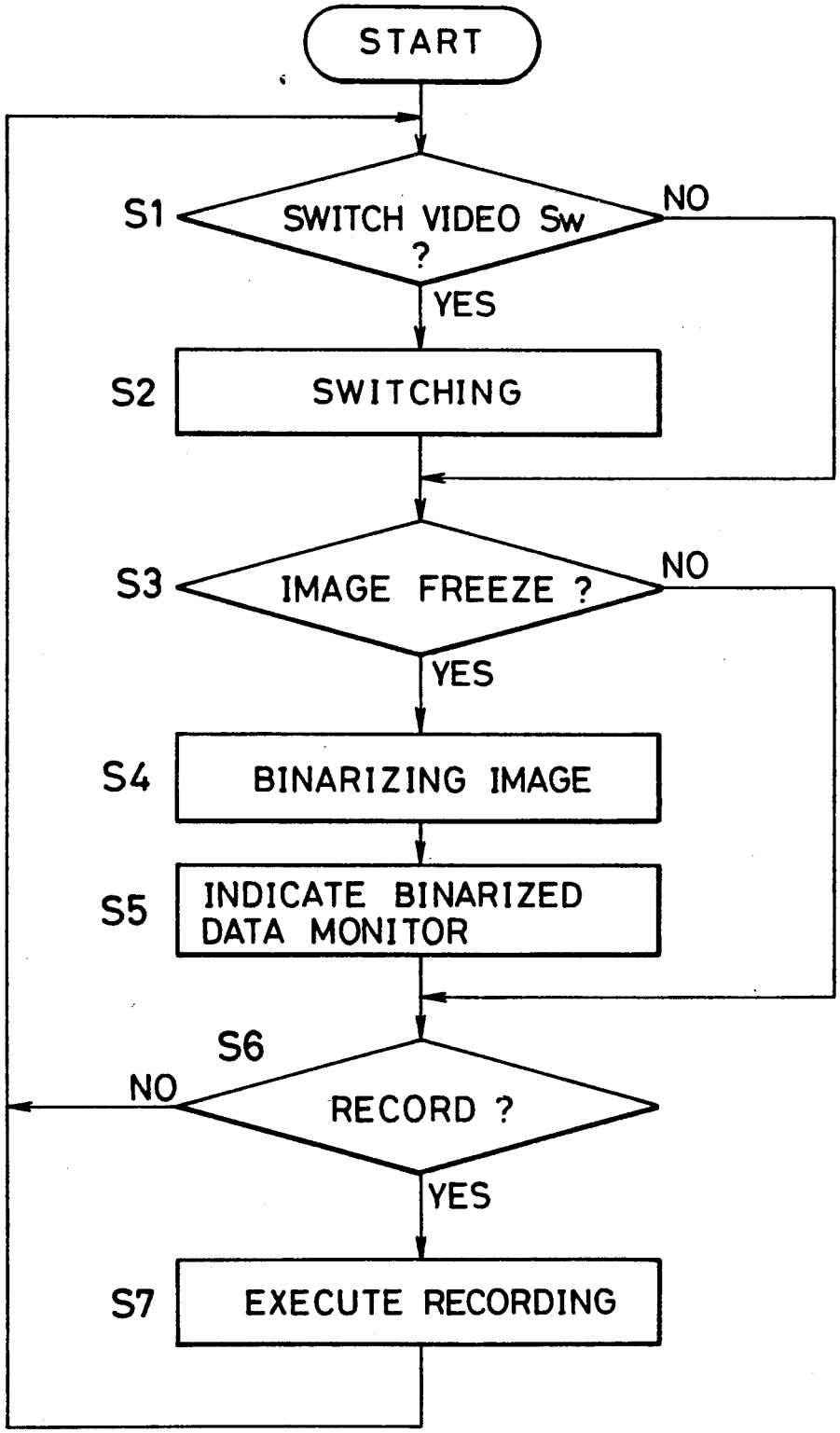
FIG. 5 is a flow chart of the control procedure.

At step S3, the depression of the image freeze switch of the console unit 56 adapted to be depressed when a desired record image is obtained from the monitor screen is detected, and at step S4, the multivalued data buffer RAM 55 of FIG. 5 is accessed for each picture element by the CPU 53 in accordance with a desired binarizing program as previously described, and after the binarization, the result is stored in the binary data buffer RAM 58. After said operation is processed by an amount corresponding to 256×256 picture elements, advance is made to step S5, where the video switch 51 is changed over and the binarized image is displayed on the monitor screen.

Step S6 is the step of detecting the depression of the upper jaw portion 1 by the operator, and when said depression is detected, it branches off to step S7, where the recording process for one sheet is executed.

By the above-described processing, the image processing of a desired screen is completed, and the memorizing operation of the image input from the outside into the multivalued data buffer RAM 55, i.e., memorization renewal, and the memorizing operation of the binary data into the binary data buffer RAM 58, i.e., memorization renewal, are temporarily stopped, whereafter they are executed each time the image freeze switch of the console unit 56 is depressed. Thereafter, the memorized image is held without being rewritten. Accordingly, where the same screen is to be recorded a plurality of times, it can be executed by only repeating the depression of the upper jaw portion 1 of the recording apparatus which is the printer unit 60.

The recording process carried out at the step S7 will now be described with reference to the timing chart shown in FIG. 6.

Figure 6:
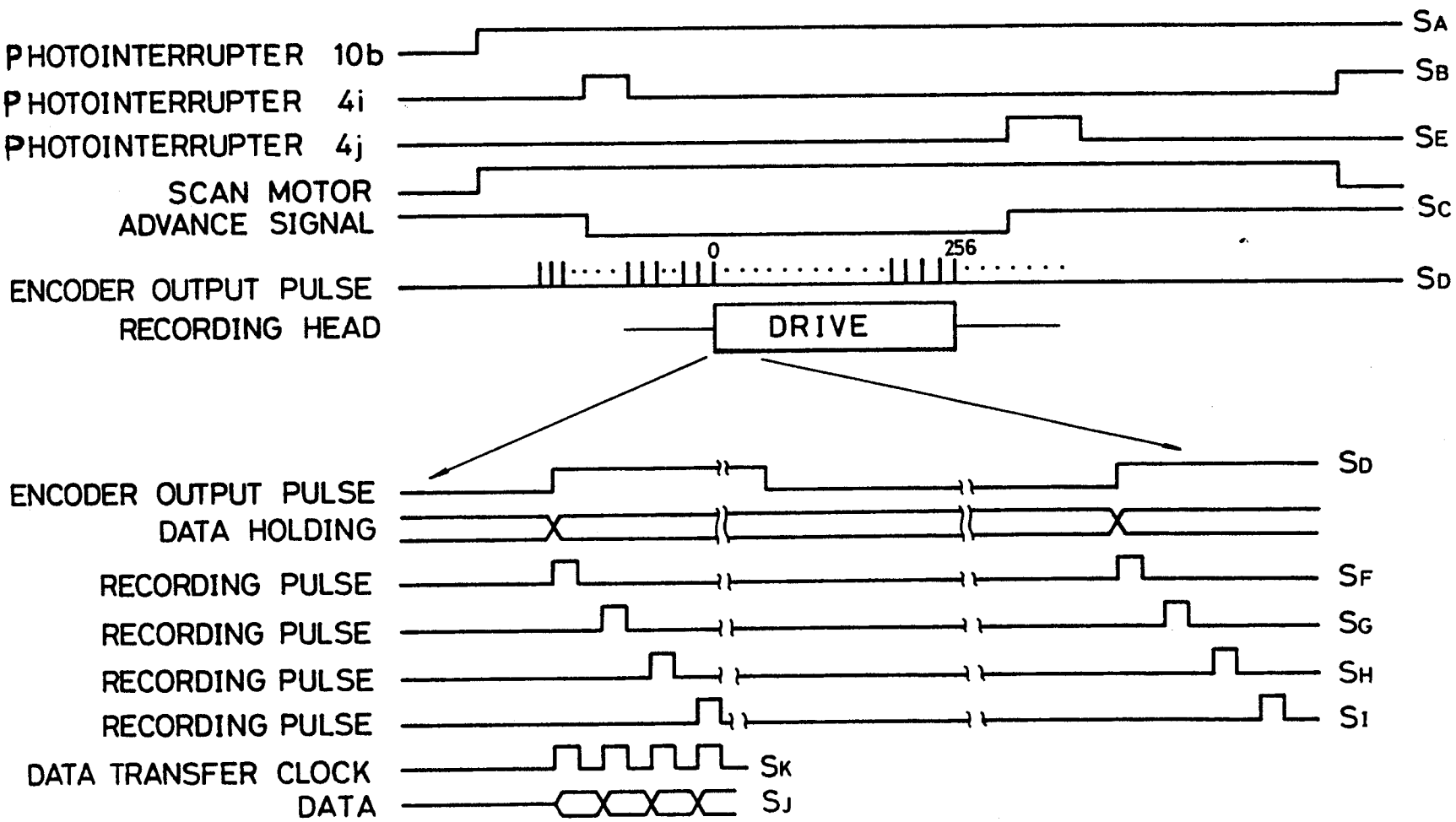
FIG. 6 is a recording timing chart.

In FIG. 6, a signal $S_A$ is the output of the photointerrupter 10*b* which detects the opening-closing of the upper jaw portion 1, and it assumes a "high" level when the upper jaw portion 1 is depressed, and by this signal $S_A$, the scanning motor 4*g* starts to drive. When the recording head 3 is not stopped at its normal stop position, the light-intercepting plate 4*k* of the head mounting plate 4*a* does not intercept the light of the photointerrupter 4*i* which is at the home position and therefore, the signal $S_B$ of the photointerrupter 4*i* becomes "low" and at this time, an advance signal $S_C$ becomes "high" and revolves the scan motor 4*g* in the reverse direction, thereby moving the recording head 3 back to the home position in the direction of arrow D in FIG. 1. When it is detected by the photointerrupter 4*i* that the recording head 3 has been returned to the home position (the signal $S_B$ is "high"), the advance signal $S_C$ is controlled to "low" and the scan motor 4*g* is revolved in the forward direction to move the recording head 3 forward in the direction of arrow C in FIG. 1.

In the present embodiment, the output pulse $S_D$ of the encoder 4*h* input to the interruption terminal of the CPU 53 is produced each time the recording head 3 scans by 1/16 mm, and after this output pulse $S_D$ has been counted by a predetermined number, that is, after the recording head 3 has scanned from the home position to the position of the positioning mark 5*c*, supply of electric power to the recording head 3 is effected. This supply of recording electric power is effected while the output pulse $S_D$ is counted by 256 (while the recording head 3 is scanned by 16 mm), and thus an image of 16 mm×16 mm is recorded. Thereafter, when the recording head 3 arrives at the reversal position, the signal $S_E$ of the photointerrupter 4*j* becomes "high", and in response to this signal $S_E$, the scan motor 4*g* revolves in the reverse direction and moves the recording head 3 backward in the direction of arrow D in FIG. 1. Further, when the recording head 3 is returned to the home position, the signal $S_B$ of the photointerrupter 4*i* becomes "high", and in response thereto, the scan motor 4*g* stops driving.

Description will now be specifically made of the timing of the driving of the recording head 3 effected each time the output pulse $S_D$ of the encoder 4*h* is input.

The recording head 3 comprises a so-called shift register and a driver, and holds the data of the shift register already transferred in synchronism with the rising of the output pulse $S_D$. Accordingly, recording is effected during said holding period. In the present embodiment, a nozzle heater corresponding to 256 picture elements is divided into four and at the same time, each 64 picture elements are recorded and thus, by four recording pulses $S_F$, $S_G$, $S_H$ and $S_I$, electric power is supplied by about 10 μm in the section during which the respective pulses are "high".

Also, as regards the recording data of the next line, data $S_J$ output from the CPU 53 within one period of the output pulse $S_D$ of the encoder 4*h* is transferred to said shift register by a data transfer clock $S_K$.

In this embodiment, design is made such that one period of the output pulse $S_D$ of the encoder 4*h* is set to about 4 ms, but if design is made such that the driving of the scan motor 4*g* when the recording head 3 is returned from the completion of recording to the home position is effected at a high speed, recording at a higher speed can be accomplished.

Also, when the operator has opened the upper jaw portion 1 during the recording operation of the recording head 3, that is, when the output of the photointerrupter 10*b* has become "low", the outputting of the recording pulses $S_F$, $S_G$, $S_H$ and $S_I$ is quickly stopped and the recording head 3 is returned to the home position.

As previously described, the same image can be stably recorded by automatically scanning the recording head 3 and the recording positioning portion 5 on the recording medium 6 can be visually confirmed by opening the upper jaw portion 1, and recording positioning can be easily accomplished.

SECOND EMBODIMENT

An embodiment in which a heat transfer recording system is used as recording means and the positioning portion can be visually confirmed without opening and closing the apparatus will now be described as a second embodiment. In the second embodiment, portions identical to those of the first embodiment are given identical reference characters and need not be described.

Figure 7:
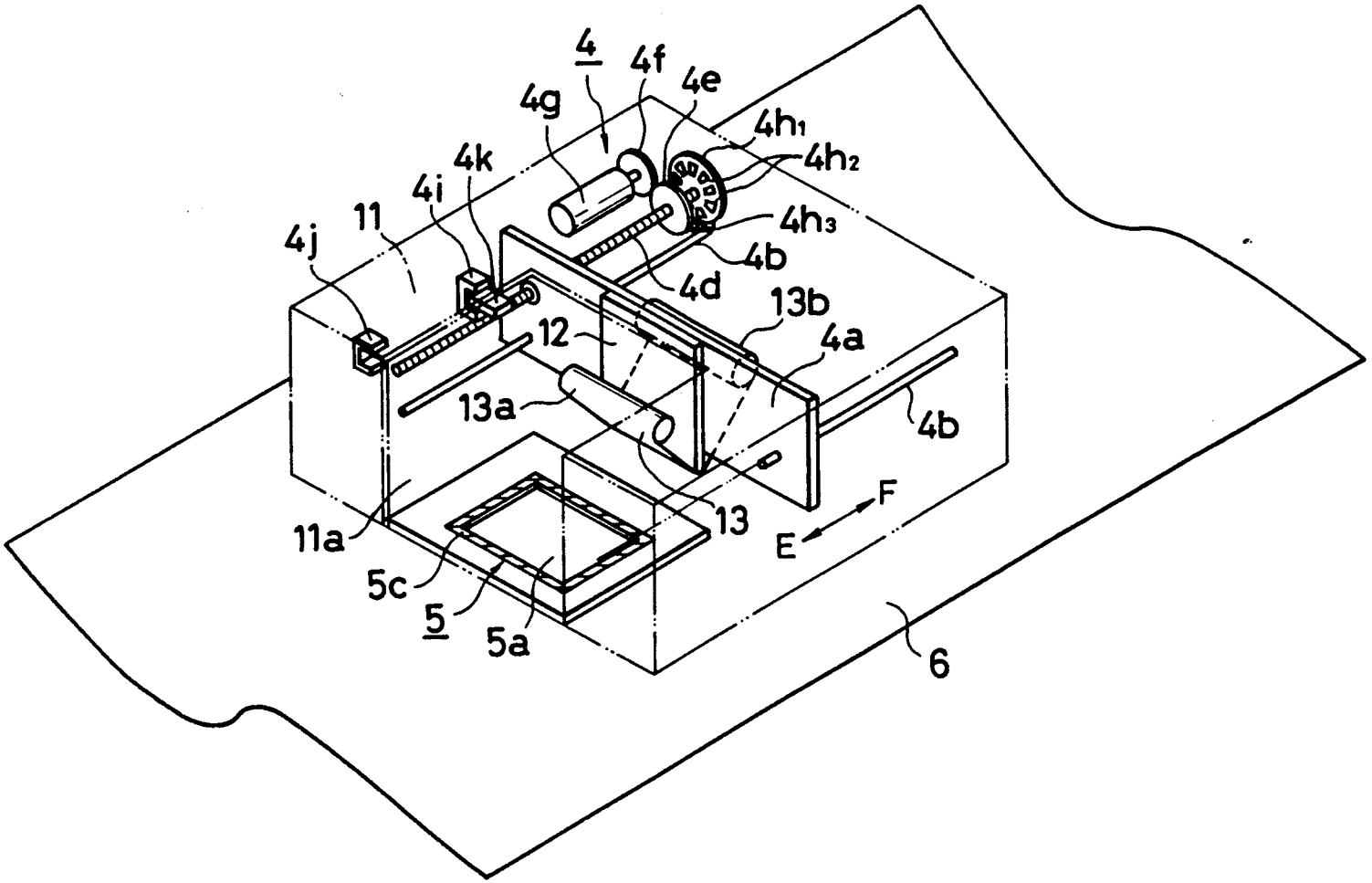
FIG. 7 is an illustration of a second embodiment of the present invention.

FIG. 7 is a perspective view of a recording apparatus according to the second embodiment. In FIG. 7, the reference numeral 11 designates a housing having a lateral U-shaped cut-away portion 11*a*, and a positioning portion 5 is formed on the bottom surface of the cut-away portion 11*a*.

Within the housing 11, a recording head 12 having heat generating elements individually electrically energized for heat generation in response to an image signal and arranged in a row of 256 dots at 16 dots/mm is mounted on a head mounting plate 4*a*, which can be scanned in the directions of arrows E and F by scanning means 4 similar to that in the first embodiment. An ink sheet 13 having heat transfer ink applied thereto is further provided on the mounting plate 4*a*, and may be taken up from a supply roll 13*a* to a take-up roll 13*b* by an actuator, not shown, during recording.

Figure 8:
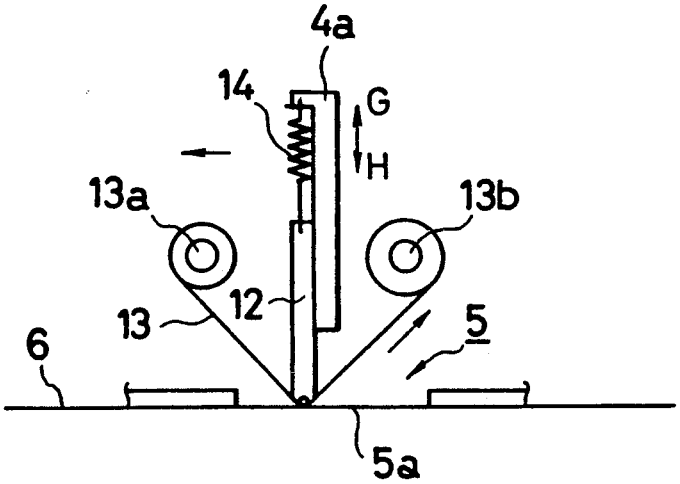
FIG. 8 is an illustration of a recording head according to the second embodiment.

Further, the recording head 12, as shown in FIG. 8, is constructed for movement relative to the head mounting plate 4*a* in the directions of arrows G and H (the upward and downward directions). That is, the recording head 12 is pulled in the direction of arrow G by a spring 14 and is movable in the direction of arrow H by an actuator, not shown.

Description will now be made of a case where recording is effected by the use of the recording apparatus constructed as described above.

The recording apparatus is first placed on a recording medium 6, and then the positioning mark 5*c* of the positioning portion 5 is registered with a location on the recording medium 6 at which recording is to be effected. At this time, the positioning portion 5 can be visually confirmed through the lateral U-shaped cut-away 11*a* and therefore, said positioning can be accomplished with ease.

When a recording start switch, not shown, is then closed, the scan motor 4*g* revolves in the forward direction and the recording head 12 scans in the direction of arrow E. After with this scanning, the encoder 4*h* has counted a predetermined number, that is, after the recording head has arrived in the positioning mark 5*c*, the recording head 12 is moved downwardly (in the direction of arrow H in FIG. 8) and presses the recording medium 6 through the ink sheet 13. In this state, the heat generating elements selectively generate heat in synchronism with the counting of the encoder 4*h* and the ink sheet 13 is taken up onto the take-up roll 13*b*. Thereby an image is recorded on the recording medium 6.

Further, after the completion of said recording, the driving of the actuator which moves the recording head 13 downwardly is released, and the recording head 12 is moved upwardly (in the direction of arrow G in FIG. 8). Then, as in the first embodiment, the recording head 12 is moved to the reversal position, whereafter it is returned to the home position.

Again in the above-described heat transfer recording system, the construction and control procedure of the control system are similar to those in the first embodiment.

OTHER EMBODIMENTS

Other embodiments of the various portions of the aforedescribed embodiments will now be described.

(1) Recording Head

In the aforedescribed embodiments, there have been shown the examples of the ink jet system and the heat transfer recording system, whereas the recording head need not be restricted to these recording systems, but use may also be made of other recording systems such as the impact recording system and the thermosensitive recording system.

(2) Scanning Means

In the aforedescribed embodiments, the encoder 4*h* has been used as the means for detecting the amount of scanning of the recording head, but without this encoder being used, a stepping motor may be used as the scan motor 4*g* and by counting the number of steps thereof, the amount of scanning of the recording head may be detected.

(3) Positioning Portion

Figure 9:
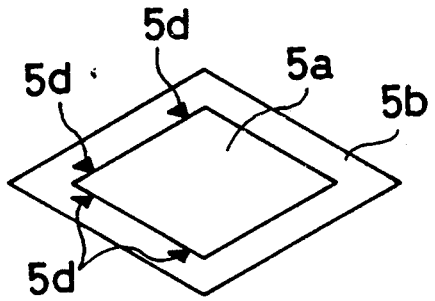
FIG. 9 is an illustration of another embodiment of the positioning portion.
Figure 11:
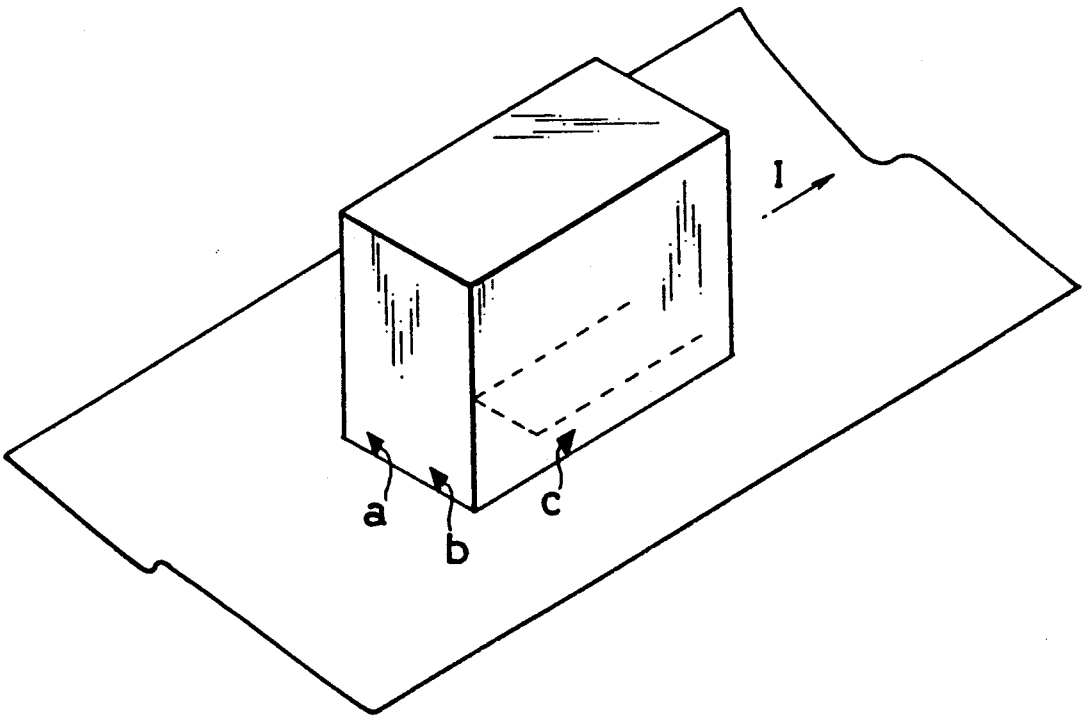
FIG. 11 PRIOR ART
FIG. 11 is an illustration of the prior art.

In the aforedescribed embodiments, the positioning mark 5*c* indicative of the recording area has been formed around the transparent window 5*b* of the positioning portion 5, but as shown in FIG. 9, marks 5*d* indicative of the recording area may be provided at predetermined locations on the transparent window 5*b*.

(4) Opening-Closing Means

Figure 10A:
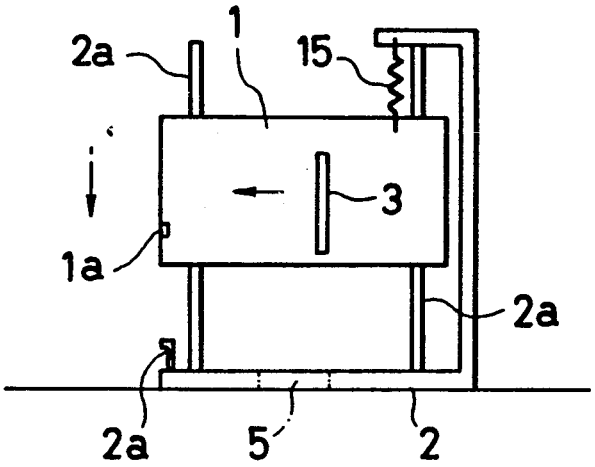
FIGS. 10A–10C are illustrations showing other embodiments of the opening-closing mechanism for the upper jaw portion and the lower jaw portion.
Figure 10B:
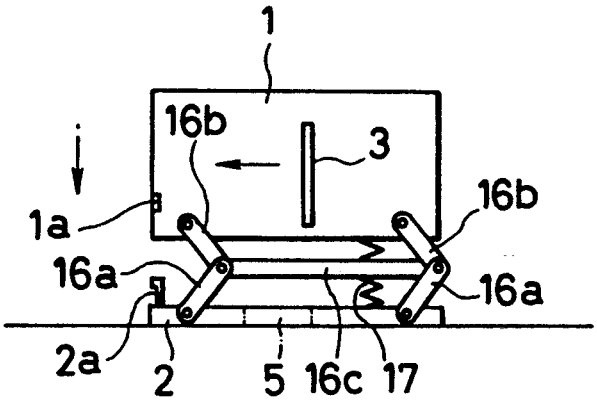
Figure 10C:
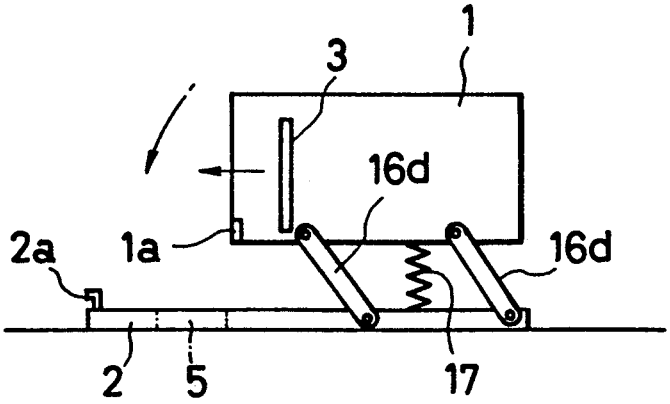

As the construction for enabling the positioning portion 5 to be visually confirmed, in the first embodiment, the upper jaw portion 1 and the lower jaw portion 2 are made openable and closable by being pivotally moved about the shaft 3, but other constructions as shown in FIGS. 10A–10C may also be adopted.

That is, as shown in FIG. 10A, the upper jaw portion 1 is constructed so as to be vertically slidable along the guide shaft 2*a* provided in the lower jaw portion 2. With such a construction, the upper jaw portion 1 and the lower jaw portion 2 become vertically openable and closable, and when the upper jaw portion 1 is slid upwardly, the positioning portion 5 provided in the lower jaw portion 2 can be visually confirmed. In FIG. 10A, the reference numeral 15 designates a tension spring for pulling the upper jaw portion 1 upwardly.

Also, in FIG. 10B, the upper jaw portion 1 and the lower jaw portion 2 are connected together by links 16*a*, 16*b* and 16*c* so that the upper jaw portion 1 can be vertically moved relative to the lower jaw portion 2 by the pivotal movement of said links. Further, again in FIG. 10C, the upper jaw portion 1 and the lower jaw portion 2 are connected together by links 16*d* so that the upper jaw portion 1 is vertically movable by the pivotal movement of said links 16*d*. Again with such a construction, when the upper jaw portion 1 is moved upwardly, the positioning portion 5 provided in the lower jaw portion 2 can be visually confirmed, and the recording positioning with respect to the recording medium 6 can be accomplished easily. In FIGS. 10B and 10C, the reference numeral 17 designates a compression spring.

(5) Recording Medium

The recording medium need not be limited to a sheet-like one such as recording paper or a plastic sheet, but recording can also be effected on a booklet such as a notebook or a book.

As previously described, the present embodiment can effect recording with the apparatus placed on the recording medium and therefore, can effect recording not only on a sheet-like medium, but also on a booklet-like medium such as a notebook or a book.

Also, the positioning portion for positioning the apparatus with respect to the recording medium can be visually confirmed and therefore, said positioning can be accomplished easily and reliably.

Further, the scanning of the recording head is automatically effected by the scanning means and therefore, highly accurate images can be repetitively recorded. That is, the present embodiment, as previously described, can accurately record even an image of high accuracy of the order of 16 pel at any desired location on the recording medium by automatically scanning the recording means by the scanning means, and the recording position can also be determined easily because the positioning portion can be visually confirmed.

Also, since recording is automatically executed with the opened or closed state of the upper jaw portion and the lower jaw portion detected, a recording start switch or the like need not be provided in the console unit and therefore, the apparatus can be made compact, and further, recording is executed by a single operation and thus, the operability of the apparatus is improved.

As described above in detail, the present invention provides a recording apparatus which can obtain clear-cut images.

We claim:

1. A recording apparatus for effecting recording on a recording medium, comprising:

an upper body comprising a recording means for effecting recording on the recording medium in conformity with an image signal, and scanning means for scanning said recording means; and a lower body having a mounting section for mounting at least a portion of said lower body on at least a portion of the recording medium, said lower body also having a viewing section through which a recording position of said recording means on the recording medium can be viewed, said upper body and said lower body being relatively movable to opened and closed positions.

2. A recording apparatus according to claim 1, wherein said viewing section has a square window.

3. A recording apparatus according to claim 2, wherein said window frames the recording area of the recording medium to be recorded by said recording means.

4. A recording apparatus according to claim 1, wherein said upper body and said lower body are pivotable about a shaft.

5. A recording apparatus for effecting recording on a recording medium, comprising:

an upper body having recording means for effecting recording on the recording medium in conformity with an image signal, and scanning means for scanning said recording means;

a lower body having a mounting section for mounting at least a portion of said lower body on at least a portion of the recording medium, said lower body also having a viewing section through which the recording area and the recording position of said recording means on said recording medium can be viewed;

means for relatively moving said upper body and said lower body between opened and closed positions;

detecting means for detecting the opened and closed positions of said upper body and said lower body and for generating a corresponding output signal; and recording control means for controlling the execution of recording of said recording means in conformity with the output signal from said detecting means.

6. A recording apparatus according to claim 5, wherein said viewing section has a square window.

7. A recording apparatus for recording on a recording medium, said apparatus comprising:

a portable frame member having a mounting section for mounting at least a portion of said frame member on at least a portion of the recording medium, said frame member also having an open section open to a recording area of the recording medium;

recording means provided on said frame member to record on the recording area of the recording medium; and driving means for automatically scanning said recording means along the recording area to record on the recording area through said frame member.

8. A recording apparatus according to claim 7, wherein said frame member has an upper unit and a lower unit which are relatively, rotatably movable to opened and closed positions, wherein said recording means and said driving means are provided on said upper unit and a window open to the recording area is provided on said lower unit.

9. A recording apparatus according to claim 8, wherein the recording area is visible through said window when said upper unit is rotated to the opened position with respect to said lower unit.

10. A recording apparatus according to claim 8, wherein a recording switch is turned on when said upper unit and said lower unit are in the closed position and enables said recording means to scan along the recording area.

11. A recording apparatus according to claim 8, wherein said frame member has a cutout portion and said window is provided on a bottom of said cutout portion.

12. A recording apparatus according to claim 7, wherein said recording means has an ink jet recording head for recording by discharging ink droplets through a discharge port.

13. A recording apparatus according to claim 7, wherein said recording means has a bubble jet recording head for recording by discharging ink droplets through a discharge port upon generation of an air bubble.

14. A recording apparatus according to claim 7, wherein said recording means has a thermal head for heating and transferring ink contained in an ink sheet to the recording medium.

15. A recording apparatus according to claim 7, wherein the recording area is visible when said upper unit and said lower unit of said frame member are in the opened position.

16. A recording apparatus according to claim 1, wherein said recording means has an ink jet recording head for recording by discharging ink droplets through a discharge port.

17. A recording apparatus according to claim 5, wherein said recording means has an ink jet recording head for recording by discharging ink droplets through a discharge port.

18. A recording apparatus according to claim 1, wherein said recording means has a bubble jet recording head for recording by discharging ink droplets through a discharge port upon generation of an air bubble.

19. A recording apparatus according to claim 5, wherein said recording means has a bubble jet recording head for recording by discharging ink droplets through a discharge port upon generation of an air bubble.

20. A recording apparatus according to claim 1, wherein said recording means has a thermal head for heating and transferring ink contained in an ink sheet to the recording medium.

21. A recording apparatus according to claim 5, wherein said recording means has a thermal head for heating and transferring ink contained in an ink sheet to the recording medium.

22. A recording apparatus according to claim 1, further comprising means for controlling the image signal to the recording means.

23. A recording apparatus according to claim 5, wherein said recording control means controls the image signal to the recording means.

24. A recording apparatus according to claim 7, further comprising means for controlling the image signal to the recording means.

* * * * *

UNITED STATES PATENT AND TRADEMARK OFFICE

CERTIFICATE OF CORRECTION

PATENT NO. : 5,063,451

DATED : November 5, 1991

INVENTOR(S) : RYOZO YANAGISAWA, ET AL.

It is certified that error appears in the above-identified patent and that said Letters Patent is hereby corrected as shown below:

Title page:

At [54] Title:

Line 1, "HAND HELD" should read --HAND-HELD--.

COLUMN 1:

Line 1, "HAND HELD" should read --HAND-HELD--.

COLUMN 5:

Line 12, "plate a" should read --plate 10a--; and

Line 42, "plate 4k re-" should read --plate 4k switches the photointerrupter 4j, the scan motor 4g re- --.

UNITED STATES PATENT AND TRADEMARK OFFICE

CERTIFICATE OF CORRECTION

PATENT NO. : 5,063,451

DATED : November 5, 1991

INVENTOR(S) : RYOZO YANAGISAWA, ET AL.

It is certified that error appears in the above-identified patent and that said Letters Patent is hereby corrected as shown below:

COLUMN 6:

Line 2, "265 x 256" should read --256 x 256--; and

Line 9, "an" should read --a--.

COLUMN 8:

Line 64, "with this scanning" should read --this scanning and--.

COLUMN 9:

Line 9, "13" should read --12--.

Signed and Sealed this

Fifteenth Day of June, 1993

Attest:

Michael K. Kirk

MICHAEL K. KIRK

Attesting Officer

Acting Commissioner of Patents and Trademarks